US009915271B2

(12) United States Patent
Sawyer

(10) Patent No.: US 9,915,271 B2
(45) Date of Patent: Mar. 13, 2018

(54) BLOWER ASSEMBLY FOR A VEHICLE

(71) Applicant: FORD GLOBAL TECHNOLOGIES, LLC, Dearborn, MI (US)

(72) Inventor: Robert Steven Sawyer, Farmington Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 336 days.

(21) Appl. No.: 14/600,563

(22) Filed: Jan. 20, 2015

(65) Prior Publication Data

US 2016/0208816 A1 Jul. 21, 2016

(51) Int. Cl.
*F04D 29/46* (2006.01)
*F04D 29/42* (2006.01)

(52) U.S. Cl.
CPC ..... *F04D 29/464* (2013.01); *F04D 29/422* (2013.01); *F04D 29/4226* (2013.01)

(58) Field of Classification Search
CPC ..... F04D 29/422; F04D 29/4226; F04D 29/4233; F04D 29/442; F04D 29/464
USPC ..... 415/126–128, 148, 150, 151
See application file for complete search history.

(56) References Cited

U.S. PATENT DOCUMENTS 960,815 A * 6/1910 Carlisle ..... F04D 29/462 126/110 A
1,056,813 A 3/1913 Mclean
5,772,399 A * 6/1998 Mehta ..... F04D 27/00 415/148
6,821,088 B2 11/2004 Sakai et al.
7,163,456 B2 1/2007 Miyata
2002/0131861 A1* 9/2002 Sakai ..... F04D 29/422 415/204
2005/0095125 A1* 5/2005 Chang ..... F04D 29/542 415/206
2008/0267764 A1* 10/2008 Tsai ..... F04D 29/4246 415/53.3

FOREIGN PATENT DOCUMENTS

JP 2002192934 A 7/2002
JP 2003042097 A 2/2003
JP 2008208798 A 9/2008

OTHER PUBLICATIONS

English machine translation of the description for JP2003042097.
English machine translation of the description for JP2008208798.
English machine translation of the description for JP2002192934.

* cited by examiner

*Primary Examiner* — Christopher Verdier
(74) *Attorney, Agent, or Firm* — Vichit Chea; King & Schickli, PLLC

(57) ABSTRACT

A blower assembly includes a housing having a scrolled wall, a motor having an output shaft extending within the housing, an impeller positioned within the housing and mounted to the output shaft for creating an airflow along an airflow path within the housing, an airflow outlet, and a scroll cut-off. The scroll cut-off may rotate about its central or center axis and forms a substantially continuous surface with the scrolled wall and with the airflow outlet, along the airflow path, in a first position and defines an air gap. The blower assembly also includes an actuator for rotating the scroll cut-off from the first position to a second position wherein the air gap is increased for reducing the airflow.

18 Claims, 3 Drawing Sheets

BLOWER ASSEMBLY FOR A VEHICLE

TECHNICAL FIELD

This document relates generally to blower assemblies used in a vehicle, and more specifically to tuneable blower assemblies associated with heating, ventilation, and air conditioning (HVAC) systems.

BACKGROUND

Blower assemblies are a common component of vehicle HVAC systems and are designed for maximum efficiency/airflow when operated in commonly known re-circulating and fresh modes. In heater mode within the fresh mode, however, the airflow volume can hinder optimal heating performance within the vehicle by over cooling the engine. As a result, the amount of heated coolant available may not be enough to warm-up the passenger compartment to a desired temperature. Even more, the noise level within the passenger compartment in this mode can reach unsatisfying levels due to the large volume of air moving through typically smaller heat passages and outlets. Accordingly, a need exists for a blower assembly that is tunable or adjustable such that a desired airflow volume can be delivered for all modes of operation including the re-circulating and heater mode combination.

While various solutions to this problem exist, each such solution has its own drawbacks. For example, reducing or restricting the airflow volume in heater mode may be accomplished by reducing the speed of the motor/impeller creating the airflow. In this instance, however, adding such restrictions to control heater airflow volume tends to increase turbulence and noise, vibration, and harshness which are equally untenable.

Alternatively, a maximum voltage applied to the motor/impeller may be clipped or limited thus reducing the maximum airflow volume. While the maximum airflow volume may be appropriately reduced using this approach, a minimum voltage applied to the motor/impeller still results in an airflow volume that is greater than what the occupant wants/needs. The minimum voltage is linked to minimum rotations per minute of the motor, and results in an excessive supply of the heated air available to warm-up the passenger compartment to the desired temperature. Even more, the steps between desired settings of high speed and low speed become compressed to the point that an occupant of the vehicle may be unable to discern any difference between the selected settings.

Another method of tuning the blower assembly such that the desired airflow volume can be delivered for all modes of operation is to adjust the scroll cut-off of the blower assembly. One manner of adjusting the scroll cut-off of a blower assembly is described in U.S. Pat. No. 1,056,813 to McLean. McLean desired to use a volume blower with a large volume between a scroll wall of a blower housing and a wheel (or impeller) as a pressure blower in some instances by controlling the point of cut-off or minimum distance between the blower housing/scroll wall and periphery of the wheel. In McLean's blower assembly, a scroll cut-off is hingedly connected to the scroll wall of the blower housing allowing the scroll cut-off to pivot about a point of attachment. A horizontal portion of the scroll cut-off overlapped an airflow outlet or discharge duct of the blower assembly, and the horizontal portion generally traversed the airflow outlet. A governor was used to adjust the minimum distance between the blower housing/scroll wall and periphery of the wheel dependent upon the speed of the motor.

Another inventor determined a different way of adjusting the scroll cut-off of a blower assembly. Japanese Patent No. 2003042097A describes an adjustment to a distance or air gap between a blower housing/scroll wall and a periphery of a wheel in blower assemblies used in vehicles. The invention is designed to overcome issues involving low frequency noise created when air blown from a centrifugal fan flows backwards into the fan due to high pressure in an air conditioning duct in a foot or a defrost mode of operation. In the blower assembly, a movable nose or scroll cut-off is provided that is pulled by a cable attached to mode selection levers. The scroll cut-off translates along a scroll wall of a housing of the blower assembly. In other modes, the cable pushes the nose or scroll cut-off back along the scroll wall toward the fan to decrease the air gap in the remaining modes of operation. The patent further teaches use of linkages in place of the cable that are actuated to move the scroll cut-off dependent upon a pressure sensor positioned to sense pressure at an airflow outlet. Another discussed alternative, is to attach the scroll cut-off to the scroll wall allowing the scroll cut-off to pivot outward when pulled by the cable thereby altering the size of the air gap. This approach is similar to the McLean approach.

This document relates to a blower assembly having a scroll cut-off that is adjustable using an actuator so that a desired airflow volume can be delivered for all modes of operation in the vehicle. Advantageously, this allows for the vehicle operator to utilize the blower assembly even in the re-circulating and heater modes. Heretofore, the rate of airflow in these modes was too high resulting in an inability to warm-up the passenger compartment to a desired temperature. Even more, the present design avoids the need for cables and/or linkages between the blower assembly and dash mounted controls, and does not result in increased turbulence and noise, vibration, and harshness.

SUMMARY

In accordance with the purposes and benefits described herein, a blower assembly is provided. The blower assembly may be broadly described as comprising a housing having a scrolled wall, a motor having an output shaft extending within the housing, an impeller positioned within the housing and mounted to the output shaft for creating an airflow along an airflow path within the housing, an airflow outlet, and a scroll cut-off rotatable about its center axis. The scroll cut-off forms a substantially continuous surface with the scrolled wall and with the airflow outlet, along the airflow path, in a first position and defines an air gap. The blower assembly also includes an actuator for rotating the scroll cut-off from the first position to a second position wherein the air gap is increased for reducing the airflow.

In one possible embodiment, the shape of the scroll cut-off is selected from an oval, a semi-oval, an oblong, a semi-oblong an ovate, a semi-ovate, an ovoid, a semi-ovoid, an ellipsis and a semi-ellipsis. In another possible embodiment, the shape of the scroll cut-off is selected from a portion (or partial piece) of an oval, a semi-oval, an oblong, a semi-oblong an ovate, a semi-ovate, an ovoid, a semi-ovoid, an ellipsis and a semi-ellipsis.

In still another possible embodiment, the scroll cut-off and the impeller define an air gap having a minimum distance in the first position. In another, the air gap defined by the scroll cut-off and the impeller so as to have a maximum distance in the second position.

In another possible embodiment, the motor and the output shaft are positioned within the housing.

In accordance with an additional aspect, a blower assembly comprises a housing having a scrolled wall, a motor having an output shaft extending within the housing, an impeller positioned within the housing and mounted to the output shaft for creating an airflow along an airflow path within the housing, an airflow outlet, and a rotatable scroll cut-off positioned between said scrolled wall and said air flow outlet, and an actuator for rotating the scrolled cut-off between a first position forming a substantially continuous wall with the scrolled wall and the air flow outlet and defining an air gap, and a second position forming a substantially continuous wall with the scrolled wall and the air flow outlet and wherein the air gap is increased from the first position to the second position for reducing the airflow.

In another possible embodiment, the shape of the rotatable scroll cut-off is selected from an oval, a semi-oval, an oblong, a semi-oblong an ovate, a semi-ovate, an ovoid, a semi-ovoid, an ellipsis and a semi-ellipsis. In yet another possible embodiment, the shape of the rotatable scroll cut-off is selected from a portion (or partial piece) of an oval, a semi-oval, an oblong, a semi-oblong an ovate, a semi-ovate, an ovoid, a semi-ovoid, an ellipsis and a semi-ellipsis.

In one other possible embodiment, the rotatable scroll cut-off and the impeller define an air gap having a minimum distance in the first position. In another, the air gap defined by the rotatable scroll cut-off and the impeller so as to have a maximum distance in the second position.

In another possible embodiment, the motor and the output shaft are positioned within the housing.

In other possible embodiments, the blower assemblies described above are incorporated into a vehicle.

In accordance with another aspect, a method of changing a rate of airflow in a blower assembly is provided. The method may be broadly described as comprising the steps of: (a) creating an airflow using an impeller positioned within a housing having a scrolled wall; (b) establishing an air gap between a scroll cut-off in a first position and the impeller, the air gap determining the rate of the airflow; and (c) adjusting the air gap to affect the rate of airflow by rotating the scroll cut-off from the first position to a second position.

In one possible embodiment, the scroll cut-off may be rotated about its central axis. In another, the scroll cut-off may form a substantially continuous surface with the scrolled wall and an air flow outlet in the first position such that the established air gap is minimized, and a substantially continuous surface with the scrolled wall and the air flow outlet in the second position such that the established air gap is maximized.

In the following description, there are shown and described several preferred embodiments of the blower assembly and the related method. As it should be realized, the assemblies and method are capable of other, different embodiments and their several details are capable of modification in various, obvious aspects all without departing from the assemblies and method as set forth and described in the following claims. Accordingly, the drawings and descriptions should be regarded as illustrative in nature and not as restrictive.

BRIEF DESCRIPTION OF THE DRAWING FIGURES

The accompanying drawing figures incorporated herein and forming a part of the specification, illustrate several aspects of the blower assembly and together with the description serve to explain certain principles thereof. In the drawing figures.

Reference will now be made in detail to the present embodiments of the blower assembly and the related method, examples of which are illustrated in the accompanying drawing figures, wherein like numerals are used to represent like elements.

DETAILED DESCRIPTION

Figure 1:
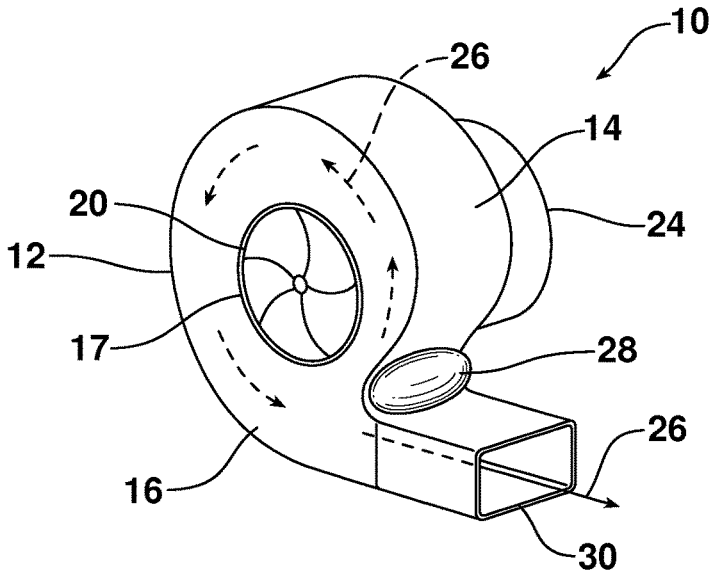
FIG. 1 is a perspective view of a blower assembly.
Figure 2:
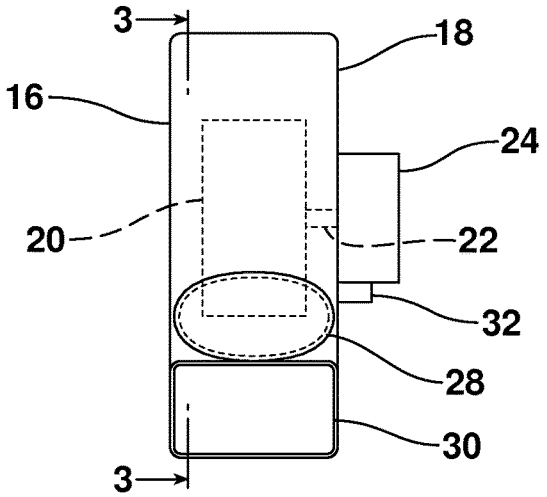
FIG. 2 is a front plan view of the blower assembly.

Reference is now made to FIGS. 1 and 2 which broadly illustrate an embodiment of a blower assembly 10 having a housing 12 including a scrolled wall 14 and side walls 16, 18. The housing is made of suitable rigid plastic materials in the present embodiment, such as, polypropylene or the like through injection, blow molded, etc. Stamped metal components could likewise be used however. An impeller 20 is positioned within the housing 12 and mounted on an output shaft 22 of a motor 24. Air is drawn into the impeller 20 through an aperture 17 in side wall 16. As shown in FIG. 2, the motor 24 in the present embodiment is mounted to the housing 12 and output shaft 22 extends into the housing where the impeller 20 is mounted. In one possible embodiment, the motor may be mounted within the housing and may even be positioned within the shaft that rotates the impeller, in order to limit the footprint of the blower assembly, as is known in the art.

In operation, motor 24 rotates output shaft 22 which in turn rotates the impeller 20 creating an airflow (generally shown by arrows 26) along an airflow path within the housing 12. The airflow 26 is generated by movement of the impeller 20 within the housing 12. The airflow 26 travels from the impeller 20 through an air gap (A) adjacent a scroll cut-off 28 within the airflow path. The airflow 26 continues around the scrolled wall 14 of the housing 12 before exiting the housing at an airflow outlet 30. The airflow outlet 30 may be attached to the housing 12, or may be integrally molded with the housing.

Figure 3:
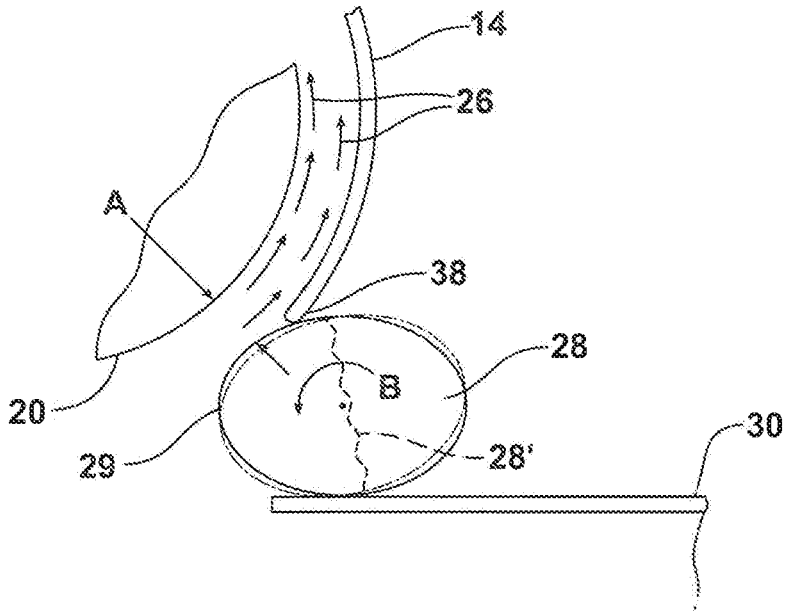
FIG. 3 is a partial cross-sectional view of the blower assembly and, in particular, an air flow within an air path and movement of a scroll cut-off along a projection of a scrolled wall.
Figure 4:
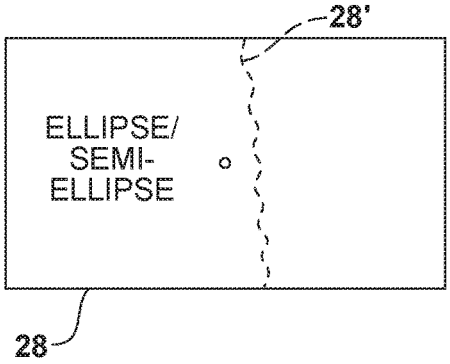
FIG. 4 shows one embodiment wherein the actuator is shaped as an ellipse and a semi-ellipse.
Figure 5:
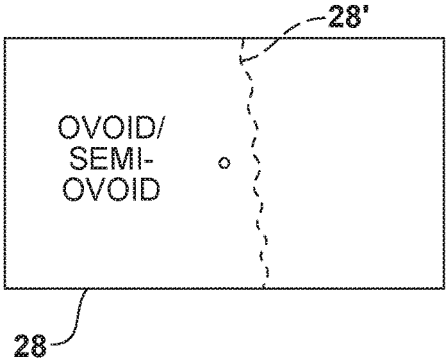
FIG. 5 shows another embodiment wherein the actuator is shaped as an ovoid and a semi-ovoid.
Figure 6:
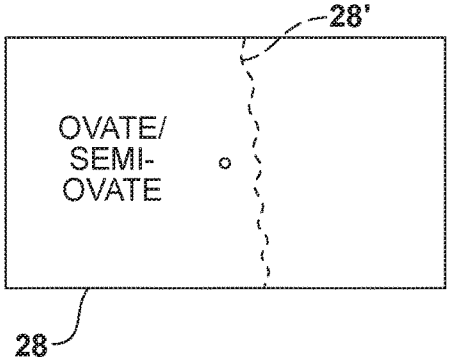
FIG. 6 shows another embodiment wherein the actuator is shaped as an ovate and a semi-ovate.
Figure 7:
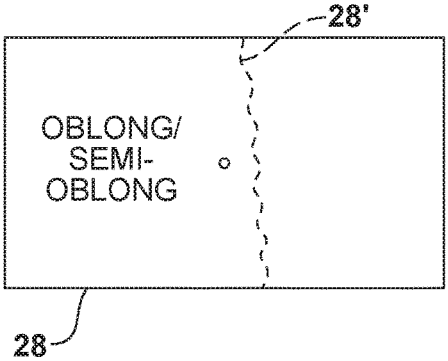
FIG. 7 shows another embodiment wherein the actuator is shaped as an oblong and a a semi-oblong.

The scroll cut-off 28, like the housing 12, is a molded polypropylene, however, other materials may be utilized for the scroll cut-off as well. As shown in FIG. 3, the scroll cut-off may be oval shaped. Even more, the scroll cut-off 28 may be an oval, an oblong, an ovate, an ovoid, and an ellipse. In other embodiments, the shape of the scroll cut-off 28 may be a portion or partial piece of an oval, i.e., a semi-oval, an oblong, i.e., a semi-oblong, an ovate, i.e., a semi-ovate, an ovoid, i.e., a semi-ovoid, and an ellipse, i.e., a semi-ellipse. In fact, any portion of these solid shapes may be used so long as an end portion 29 is sufficient to form a substantially continuous wall with the scrolled wall 14 and the air flow outlet 30 in a first position wherein the air gap (A) is a minimum distance and a second position wherein the air gap (A) is a maximum distance. As shown in FIGS. 3 and 4-7, the dashed lines to which reference numeral 28' is attached represent a cutoff or second end portion of the semi-shapes. For example, the end portion 29 of actuator 28 up to and including the dashed line in FIG. 3 represents a semi-oval shaped actuator 28'.

As shown in FIG. 3, the distance between the impeller 20 and the scroll cut-off 28 defines air gap (A) through which the airflow 26 travels. As is known in the art, that distance, or the size of the air gap (A), affects the rate of the airflow as it travels along the airflow path and exits the housing 12 at the airflow outlet 30. Altering the position of the scroll cut-off 28 relative the impeller 20 increases or decreases the rate of the airflow 26.

In the described embodiment, actuator 32 is a vacuum actuator and is mounted to the housing 12 for rotating the scroll cut-off 28. As shown by action arrow B in FIG. 3, the scroll cut-off 28 is rotated by the actuator. In the described embodiment, the rotation is about a center or central axis of the scroll cut-off 28 between first and second positions. Also, the actuator 32 may be driven utilizing a vacuum source, an electrical source, a pneumatic source, or even through linkages.

In FIG. 3, the scroll cut-off 28 is shown in solid lines in the first position where the scroll cut-off forms a substantially continuous surface with the scrolled wall 14 and the airflow outlet 30. In the first position, the air gap (A) between the impeller and the scroll cut-off 28 is a minimum distance and the rate of airflow 26 is at a maximum.

When it is desired to lower the rate of airflow 26 from the maximum rate, without changing the speed of the motor 24/impeller 20, the actuator 32 is energized to rotate the scroll cut-off 28 from the first position to the second position (shown in dashed lines in FIG. 3) such that the distance between the impeller 20 and the scroll cut-off 28, i.e., the air gap (A), is increased. The rate of the airflow 26 can be controlled to a desired rate including the maximum rate when the air gap (A) is a minimum distance, in the first position, a minimum rate when the air gap (A) is a maximum distance in a second position, and any rate between the maximum and minimum, in an intermediary position.

In another aspect of the invention, a method of changing a rate of airflow in a blower assembly 10 includes the steps of creating an airflow 26 using an impeller 20 positioned within a housing 12 having a scrolled wall 14, establishing an air gap (A) between a scroll cut-off 28 in a first position and the impeller, and adjusting the air gap to affect the rate of airflow by rotating the scroll cut-off from the first position to a second position.

The airflow 26 is created by driving the impeller 20 with a motor 24 such that the impeller rotates creating a flow of air within the housing 12. The rate of airflow 26 is determined by the air gap (A) which is the distance between the scroll cut-off 28 and the impeller 20 in the first position shown in solid lines in FIG. 3. The air gap (A) is established by rotating the scroll cut-off 28 to move the scroll cut-off to a desired position between or including the first position and the second position (shown in dashed lines in FIG. 3). Once the desired position is established creating a desired rate of airflow, the air gap (A) may be adjusted to affect the rate of airflow. The air gap (A) is adjusted by rotating the scroll cut-off to a different position between or including the first and second positions. In the described method, the scroll cut-off 28 is rotated about its center or central axis.

If the air gap (A) is established at a midpoint between the first and second positions, then the actuator 32 would rotate the scroll cut-off toward the second position in order to decrease the rate of air flow by widening the air gap (A). Conversely, the actuator 32 would rotate the scroll cut-off toward the first position in order to increase the rate of air flow by lessening the air gap (A).

In summary, numerous benefits result from providing a blower assembly having a rotatable scroll cut-off that is adjustable using an actuator so that a desired airflow volume can be delivered for all modes of operation in the vehicle. This allows for the vehicle operator to utilize the blower assembly even in the re-circulating, fresh, and heater modes. Heretofore, the rate of airflow in these modes was too high resulting in an inability to warm-up the passenger compartment to a desired temperature and known means of lowering the rate of airflow created unintended and undesired circumstances.

The foregoing has been presented for purposes of illustration and description. It is not intended to be exhaustive or to limit the embodiments to the precise form disclosed. Obvious modifications and variations are possible in light of the above teachings. All such modifications and variations are within the scope of the appended claims when interpreted in accordance with the breadth to which they are fairly, legally and equitably entitled.

What is claimed:

1. A blower assembly, comprising:

a housing having a scrolled wall;

a motor having an output shaft extending within said housing;

an impeller positioned within said housing and mounted to said output shaft for creating an airflow along an airflow path within said housing;

an airflow outlet; and a scroll cut-off positioned between said scrolled wall and said air flow outlet, said scroll cut-off rotatable between a first position forming a substantially continuous wall with said scrolled wall and said air flow outlet and defining an air gap, and a second position wherein the air gap is increased; and an actuator for rotating said scroll cut-off around a substantially central axis extending through said scroll cut-off from the first position to a second position for reducing the airflow.

2. The blower assembly of claim 1, wherein a shape of said scroll cut-off is selected from an oval, a semi-oval, an oblong, a semi-oblong, an ovate, a semi-ovate, an ovoid, a semi-ovoid, an ellipse and a semi-ellipse.

3. The blower assembly of claim 2, wherein said scroll cut-off and said impeller define an air gap having a minimum distance in the first position.

4. The blower assembly of claim 3, wherein the air gap defined by said scroll cut-off and said impeller has a maximum distance in the second position.

5. The blower assembly of claim 1, wherein the shape of said scroll cut-off is selected from a partial piece of an oval, a semi-oval, an oblong, a semi-oblong, an ovate, a semi-ovate, an ovoid, a semi-ovoid, an ellipse and a semi-ellipse.

6. The blower assembly of claim 5, wherein said scroll cut-off and said impeller define an air gap having a minimum distance in the first position.

7. The blower assembly of claim 6, wherein the air gap defined by said scroll cut-off and said impeller has a maximum distance in the second position.

8. A vehicle incorporating the blower assembly of claim 1.

9. A blower assembly, comprising:

a housing having a scrolled wall;

a motor having an output shaft extending within said housing;

an impeller positioned within said housing and mounted to said output shaft for creating an airflow along an airflow path within said housing;

an airflow outlet;

a rotatable scroll cut-off positioned between said scrolled wall and said air flow outlet; and an actuator for rotating said scroll cut-off around a substantially central axis extending through said scroll cut-off between a first position forming a substantially continuous wall with said scrolled wall and said air flow outlet and defining an air gap, and a second position forming a substantially continuous wall with said scrolled wall and said air flow outlet and wherein the defined air gap is increased from the first position to the second position for reducing the airflow.

10. The blower assembly of claim 9, wherein a shape of said rotatable scroll cut-off is selected from an oval, a semi-oval, an oblong, a semi-oblong, an ovate, a semi-ovate, an ovoid, a semi-ovoid, an ellipse and a semi-ellipse.

11. The blower assembly of claim 10, wherein said rotatable scroll cut-off and said impeller define an air gap having a minimum distance in the first position.

12. The blower assembly of claim 11, wherein the air gap defined by said rotatable scroll cut-off and said impeller has a maximum distance in the second position.

13. The blower assembly of claim 9, wherein the shape of said rotatable scroll cut-off is selected from a portion of an oval, a semi-oval, an oblong, a semi-oblong, an ovate, a semi-ovate, an ovoid, a semi-ovoid, an ellipse and a semi-ellipse.

14. The blower assembly of claim 13, wherein said rotatable scroll cut-off and said impeller define an air gap having a minimum distance in the first position.

15. The blower assembly of claim 14, wherein the air gap defined by said rotatable scroll cut-off and said impeller has a maximum distance in the second position.

16. The blower assembly of claim 9, wherein said scroll cut-off rotates about its central axis between the first and second positions.

17. A method of changing a rate of airflow in a blower assembly comprising the steps of:

creating an airflow using an impeller positioned within a housing having a scrolled wall;

establishing an air gap between a scroll cut-off in a first position and said impeller, said air gap determining the rate of the airflow; and adjusting the air gap to affect the rate of airflow by rotating said scroll cut-off around a substantially central axis extending through said scroll cut-off from the first position to a second position.

18. The method of changing a rate of airflow in a blower assembly of claim 17, wherein said scroll cut-off forms a substantially continuous surface with said scrolled wall and an air flow outlet in the first position such that the established air gap is minimized, and a substantially continuous surface with said scrolled wall and said air flow outlet in the second position such that the established air gap is maximized.

* * * * *